US005865539A

United States Patent [19]

Rogers

[11] Patent Number: 5,865,539

[45] Date of Patent: Feb. 2, 1999

[54] ROTARY MIXING DEVICE FOR FLUIDIC MATERIAL

[76] Inventor: Mike Rogers, 932 - 4th St., Clarkston, Wash. 99403

[21] Appl. No.: 940,608

[22] Filed: Sep. 30, 1997

[51] Int. Cl.[6] ..... B01F 7/32

[52] U.S. Cl. ..... 366/325.8; 366/343; 366/129; 416/227 R

[58] Field of Search ..... 366/64, 65, 102, 366/129, 262–265, 342, 343, 605, 325.7, 325.8; 416/178, 187, 227 R

[56] References Cited

U.S. PATENT DOCUMENTS

| | | | |
|---|---|---|---|
| 106,704 | 8/1870 | Loud | 416/227 |
| 1,031,666 | 7/1912 | Richmond . | |
| 2,520,577 | 8/1950 | Tooley . | |
| 2,753,162 | 7/1956 | Conley | 416/178 X |
| 3,067,988 | 12/1962 | Rodoz . | |
| 3,166,303 | 1/1965 | Chapman | 366/129 |
| 3,690,621 | 9/1972 | Tanaka et al. | 366/265 |
| 3,813,083 | 5/1974 | Risse . | |
| 4,065,107 | 12/1977 | Van Horbek | 366/343 |
| 4,163,616 | 8/1979 | Claunch | 366/262 |
| 4,175,875 | 11/1979 | Van Horbek | 366/343 |
| 4,472,063 | 9/1984 | Eickelmann | 366/129 |
| 4,844,355 | 7/1989 | Kemp, Jr. et al. | 366/343 X |
| 4,893,941 | 1/1990 | Wayte | 366/265 |
| 4,948,262 | 8/1990 | Tome, Jr. | 366/129 |
| 5,470,148 | 11/1995 | Gorr | 366/64 |

FOREIGN PATENT DOCUMENTS

| | | | |
|---|---|---|---|
| 2225800 | 7/1980 | Germany | 366/343 |
| 1064111 | 4/1967 | United Kingdom | 366/129 |

*Primary Examiner*—Charles E. Cooley
*Attorney, Agent, or Firm*—Keith S. Bergman

[57] ABSTRACT

A rotary mixing device provides an elongate powering shaft carrying at a first end portion mixing apparatus formed by a first outer annulus interconnected by quadrantally arrayed first radial elements to the first end portion of the powering shaft, and a second inner annulus spacedly distant along the powering shaft from the first annulus and having quadrantally arrayed second radial elements interconnecting the second annulus and the powering shaft, with each of the second radial elements of the second annulus being coplanar with one of the first radial elements of the first annulus. Elongate peripheral elements extend in quadrantal array to interconnect the first and second annuli with end portions immediately radially outwardly from each coplanar pair of first and second radial elements. The elements of the mixing device and the powering shaft are formed of rigid rod-like material having a circular cross-section of substantial area such that the volume of the mixing device comprises from ten to twenty percent of the volume defined by a figure that would contain the mixing device in an immediately adjacent relationship.

7 Claims, 2 Drawing Sheets

ROTARY MIXING DEVICE FOR FLUIDIC MATERIAL

BACKGROUND OF INVENTION

RELATED APPLICATIONS

There are no applications related hereto heretofore filed in this or any foreign country.

1. Field of Invention

This invention relates generally to rotary mixing apparatus, and more specifically to such an apparatus that is peripherally defined by elongate cylindrical elements that have substantial cross-sectional area perpendicular to their rotational direction to create turbulence upon rotation.

2. Background and Description of Prior Art

Apparatus moved by a powered rotating shaft has long been known for mixing fluidic, semi-fluidic (viscous) and quasi-fluidic (containing solid particles) materials to form a more homogenous mixture. Such apparatus has taken many and various forms determined primarily by the configuration of the mixing apparatus, the nature of the material being admixed and the rotational speed of the apparatus. Though the historical developmental period of such mixing apparatus has been long and throughout that period the apparatus developed has become increasingly sophisticated, problems still remain with such apparatus, and especially in any generic type of apparatus that well and efficiently mixes both low viscosity fluids and more highly viscous semi-fluid and quasi-fluid materials. The instant device provides a mixing apparatus, usable in a wide variety of materials and through a wide range of rotary speeds, with substantial efficiency.

Rotary mixing apparatus may be divided into two generalized classes for ease of consideration, with a first class comprising devices intended to mix more fluidic materials generally at relatively higher rotary speeds and a second class intended to mix more viscous semi-fluidic material or quasi-fluidic material containing particulate matter at slower speeds.

The first class of mixing apparatus generally provides a plurality of interconnected elements, usually of circularly symmetrical array and generally of smaller cross-sectional area in a plane perpendicular to the direction of rotation than do mixing devices of the second class. Such configuration allows more rapid rotation of the mixing apparatus without excessive force on any of the rotating elements and allows sufficient rotary speed to create a vortical type configuration in a fluid being admixed without ejecting the fluid from a container that is not of substantially greater volume than the fluid. The vortical type action of such mixers is considered by most users to provide a better and more rapid mixing of the components of a mixture to create a homogenous product. Such mixers, however, are not practical or efficient for mixing viscous semi-fluidic material or quasi-fluidic material containing particulate matter, as their structure is not strong enough to allow rapid rotation and the size of the mixing elements is not great enough to create sufficient material friction and motion for proper mixing. Additionally this first class of apparatus generally has a circularly symmetrical structure to promote rotation at higher speeds without excessive vibrations which normally cannot be completely restrained and this, especially when coupled with small cross-sectional size of the elements, further reduces the efficiency of mixing of viscous material.

Rotary mixers of the second class generally are rotated at lower speeds and present cross-sectional patterns of greater areal extent in a plane perpendicular to the direction of rotation of the mixer, so as to create motion in the material adjacent to the mixer elements relative to the material spacedly adjacent thereto which causes motion in the relatively moving portions of material to more efficiently and effectively accomplish the mixing function.

Generally the members of this second class of apparatus have provided flat blade-like elements, often particularly shaped to aid their function, that are of substantial area. Such blade-like elements often are angulated to a plane perpendicular to their direction of rotation to allow rotation at a higher speed and to direct the motion of material impinging thereon in a more efficient mixing action. Since these devices rotate at relatively slower speeds than apparatus of the first class, it is not necessary that they be of so symmetrical a nature as higher speed devices of the first class and often an asymmetrical configuration has been used to enhance the mixing action of the second class of mixing apparatus.

The instant device combines features of both the first and second class of mixing apparatus described to provide a new mixing device that functions equally well at higher speeds in more fluidic, lower viscosity materials and also at slower speeds in more viscous semi-fluidic and quasi-fluidic materials.

To accomplish these ends a mixer structure formed of interconnected areally larger rod elements of circularly symmetrical array is provided. The rod elements are spatially arrayed so that when the structure is rotated some elements move in each of three mutually perpendicular planes to maximize their mixing function. The cross-sectional size of the elements in a plane perpendicular to their direction of rotation is substantially greater than that of wire-like elements that have heretofore been used in rotary mixing devices for fluidic material of low viscosity. The instant elements allow the mixing of low viscosity fluids at speeds that create a vortical motion and tend to enhance that mixing by the creation of greater fluidic friction and turbulence about the interface of the moving elements and fluid being mixed with greater motion of the fluid surrounding the moving elements relative to the fluid more distant therefrom to accelerate and make more efficient the mixing action. The mixing action is also enhanced at lower rotary speeds in more viscous mixtures where the curvilinear shape of the moving elements allow higher speeds than normally attained in prior viscous material mixers, so that the mixing action of the larger surface and cross-sectional areas and higher rotary speeds synergistically combine to provide a more efficient and rapid mixing action for viscous materials.

My invention resides not in any one of these features individually, but rather in the synergistic combination of all of the structures of my mixing device that necessarily give rise to the functions flowing therefrom.

SUMMARY OF INVENTION

My mixing device provides a circularly symmetrical, peripherally defined structure formed by two similar spaced annuli each having four quadrantally arrayed radial elements connecting each annuli with an axially aligned medial rod for powered rotation. Each radial element of one annulus is coplanar with a radial element of the other annulus and the annuli are interconnected with each other by quadrantally spaced, peripheral rods extending therebetween at the radially outer ends of each coplanar pair of radial elements. All mixer elements are formed of similar cylindrical rod having a diameter such that all elements collectively define a volume of approximately thirteen percent of the volume that would be enclosed by the surface of a solid figure containing the mixing apparatus. A species of the mixer has annuli of different diameters to provide a truncated conic structure of similar construction. The smaller truncated surface normally will be at the innermost end of the mixing device proximal to a powering source and its base outermost distal from the powering source, though a reversed configuration may also be used but normally not so efficiently.

In providing such device, it is:

A principal object to create a rotary mixer that is peripherally defined by elements of curvilinear cross-sectional configuration, some of which move in each of three mutually perpendicular planes during rotation.

A further object is to provide such a device that is formed of cylindrical rod-like elements that provide a substantial cross-sectional area in a plane perpendicular to the direction of rotation of the apparatus so that the volume of the mixer comprises approximately thirteen percent of the volume of the figure defined by the surface containing it.

A still further object is to provide such a device that may have mixing elements that vary from circular cross-sectional shape to provide curvilinear cross-sections that have greater area in a plane perpendicular to the direction of their rotation than in any other plane.

A still further object is to provide such a device that is of circular symmetrical configuration to minimize vibrational forces created by rotation of the apparatus.

A still further object is to provide such a device that may be rotated at greater speeds in less viscous material and slower speeds in more viscous material to synergistically accentuate its mixing functions in materials of either type at such variant speeds.

A still further object is to provide such a mixing device that is of new and novel design, of rugged and durable nature, of simple and economic manufacture and otherwise well adapted for the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement, with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Figure 4:
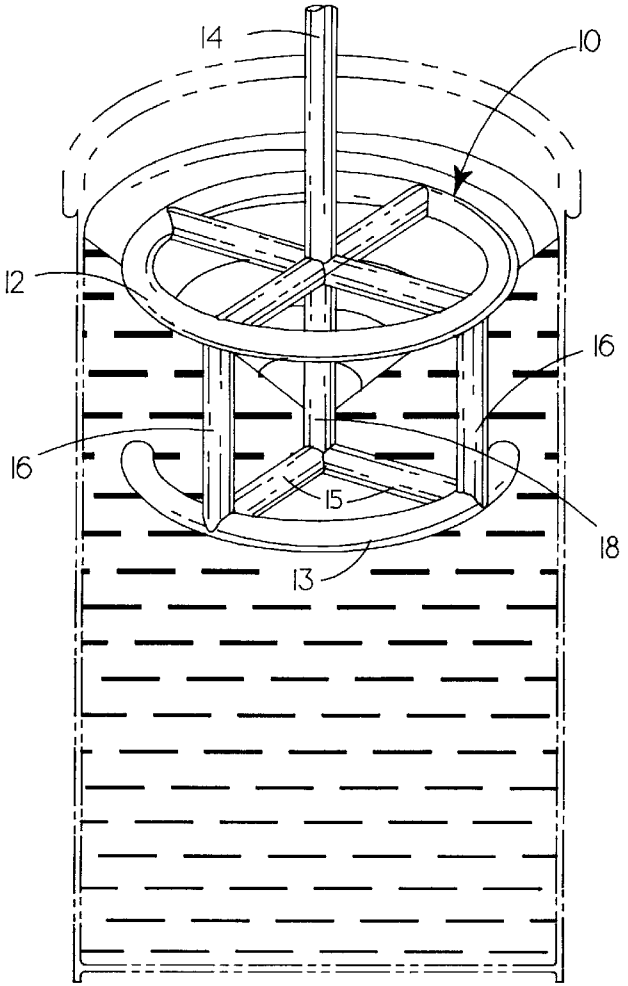
FIG. 4 is an isometric illustration of the mixing device of FIG. 1 operating in fluidic material to create a vortex, with part of the container and fluidic material cut away for illustrative purposes.
Figure 1:
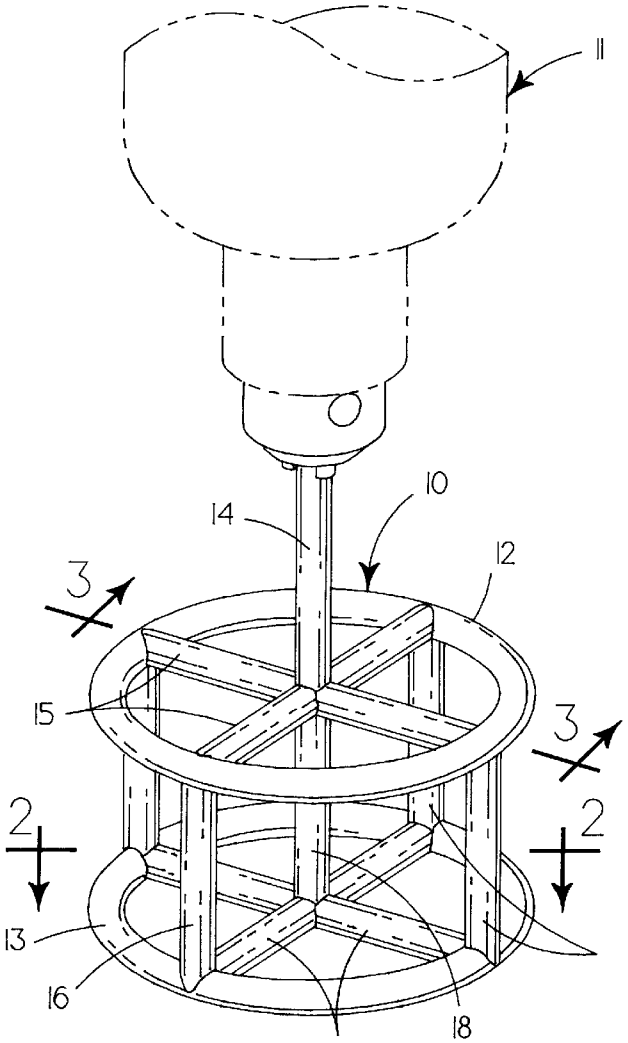
FIG. 1 is an isometric view of my mixing device interconnected with a rotary powering source, partially shown in dashed outline.

My mixing apparatus 10, as seen in FIG. 1, provides upper annulus 12 and lower annulus 13 carried in spaced parallel relationships on medial elongate powering shaft 14 by plural radial elements 15. The radial elements 15 are all similar to mount the annuli 12 and 13 with the center of each annuli in alignment with the axis of powering shaft 14. Radial elements 15 associated with each annulus preferably are four in number and quadrantally arrayed, with their axes defining radii of the supported annulus and each radial element of each annulus being coplanar with one radial element of the other annulus.

The two annuli 12 and 13 are carried on the powering shaft 14, with one annuli at the outer end portion 12 of the powering shaft and the other annuli spacedly inwardly therefrom. Preferably the space between annuli is somewhat less than the diameter of the annuli and preferably approximately two-thirds of that diameter, though this distance is not critical and variation will cause results that differ in different sized containers and different depths of material to be admixed. The spacing between annuli provides operative mixers at least in the range from ten to more than two hundred fifty percent of the diameter of the annuli.

The length of the powering shaft 14 is not critical, but should be such as to allow the shaft to extend rearwardly or spacedly away from the annuli 12 and 13 a sufficient distance to allow interconnection with a power source 11 and provide for convenient use. The distance should not be greater than necessary, however, as this may induce undesirable vibratory reactions.

The two annuli 12 and 13 are further maintained in their spaced parallel relationship by plural peripheral elements 16 extending therebetween, preferably as in the instance illustrated at the radially outer ends of each pair of coplanar radial element so that the four peripheral elements will be quadrantally arrayed in a radially symmetrical fashion. The number of peripheral elements used is not critical within reasonable limits and they need not necessarily be arrayed peripherally adjacent the end portions of radial elements, with the form illustrated being only a preferred form and not intended to be limiting. The action of my mixer, however, is affected by the number of peripheral elements and their array. If that number be too small or too large, mixing is adversely affected. The mixing action is also deleteriously affected if the peripheral elements are not in a radially symmetrical array, and this may induce vibrations in the mixer upon rotation, especially at higher speeds.

The elements of the mixer are formed of either cylindrical rod or tube of sufficient rigidity and strength to provide a configurationally sustaining structure under the various environmental conditions under which it operates. The intersections at which these elements join are appropriately configured to create a durable structural joinder, normally by welding in the case of metal elements and susceptible plastics and commonly by adhesion with other polymeric materials. It is possible that the mixing apparatus might be formed by molding in one or more pieces from moldable metallic or polymeric materials, but this method of formation generally is not the easiest and most economical method of manufacture. If the mixer is formed of tubular material, the tube channels should be sealed at each intersection.

The cross-sectional size of the elements and the configuration of the mixing apparatus which determine the volume of my mixer are essentially related to its functioning. The mixer volume is substantially greater, by a numerical factor of three to ten fold, than the same parameters as have existed in heretofore known mixing devices of the same general type. In the preferred form of mixer illustrated, with the various elements forming its structure of a rod-like nature having a circular cross-section and an overall cylindrical configuration, the ratio of the volume occupied by the mixer to the volume of a solid figure enclosing it in immediately adjacent relationship should range from approximately ten to twenty percent. In the preferred form illustrated this ratio is substantially thirteen percent.

Mixing devices of the same general type known in the prior art have generally had parameters such that the mixer volume ratio is approximately one percent and in some instances ranging upwardly to about three percent of the volume of a figure enclosing the mixer. The general efficiency of mixing with my mixer appears to be maximized with the mixer volume ratio of approximately thirteen percent of the enclosing figure volume and that efficiency becomes less in a composite of all types of material as it becomes either lesser or greater, though in particular materials the efficiency may increase with some variation, generally of not more than five percent from the preferred thirteen percent ratio.

It is also possible that the rod-like elements from which my mixer is formed may have other than circular cross-sections, and particularly may comprise cross-sectional configurations that have more area in the plane of rotation of the device than in other elongate planes therethrough. Such variant cross-sections are within the ambit and scope of my invention so long as they meet the volume requirements before specified, but their efficiency varies according to the cross-sectional shapes and the material being mixed. That efficiency seems generally to become less as the cross-sectional shape varies from a circle.

Figure 5:
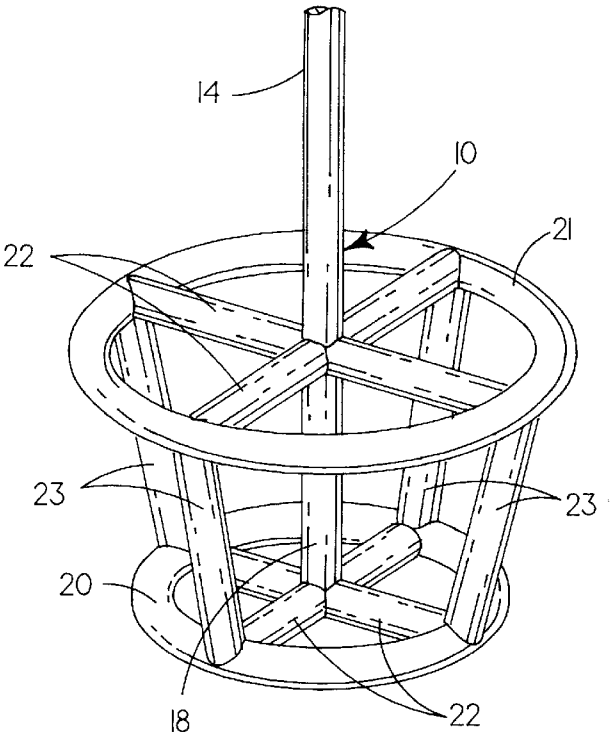
FIG. 5 is an isometric view of a species of my mixing device with a truncated conical configuration.
Figure 3:
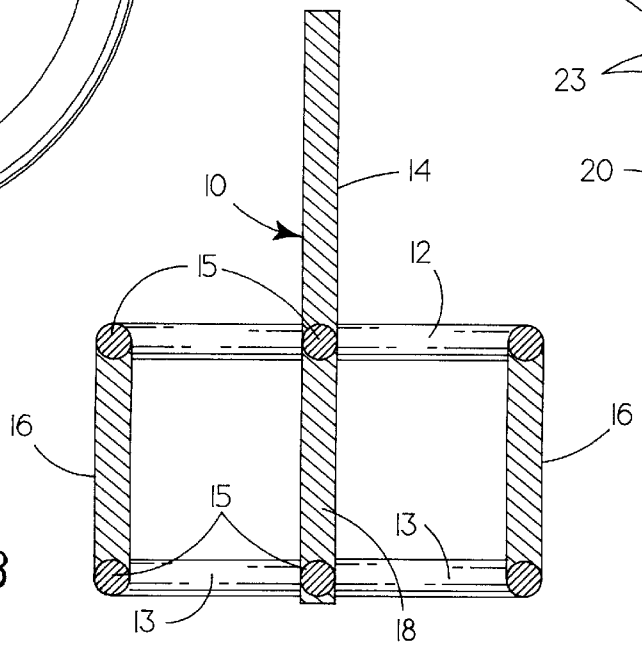
FIG. 3 is a vertical medial cross-sectional view of the mixing device of FIG. 1, taken on the line 3—3 thereon in the direction indicated by the arrows.
Figure 2:
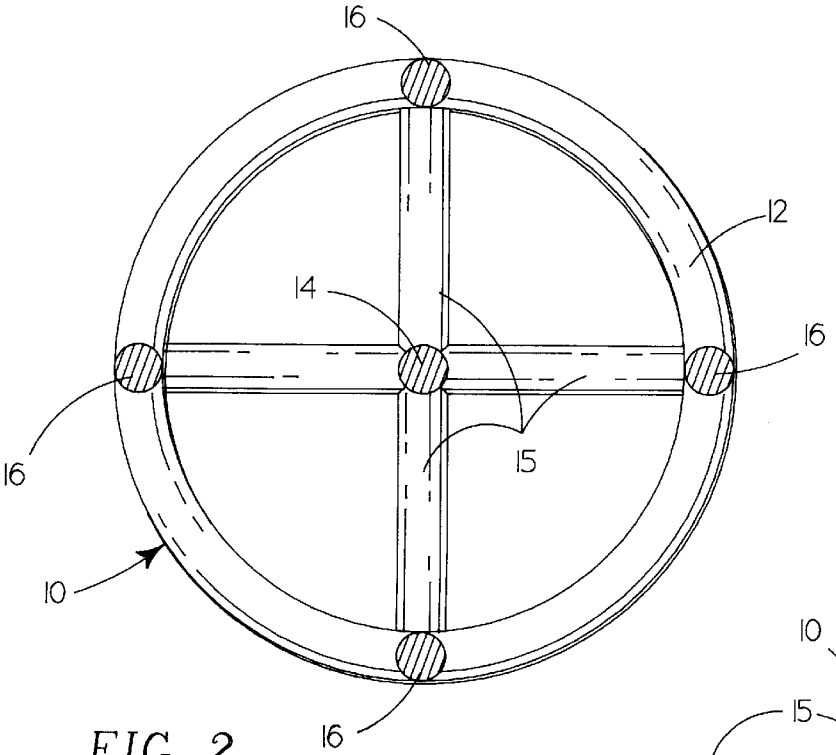
FIG. 2 is a horizontal cross-sectional view of the mixing device of FIG. 1, taken on the line 2—2 thereon in the direction indicated by arrows.

It is not necessary that the two annuli of my mixer be of the same size and one may be smaller than the other to create a mixer having a general peripheral configuration of a truncated cone. Such a second species of my mixing apparatus is illustrated in FIG. 5 where it is seen to comprise elongate medial powering shaft 14 carrying diametrically larger upper annulus 21 at its inner end portion, proximal from a powering source, and outwardly spacedly adjacent diametrically smaller lower annulus 20. These annuli 20 and 21 are carried on the powering shaft by quadrantally arrayed radial elements 22 of appropriate length similarly to the radial support structure of the first species and the two annuli are radially oriented on the powering shaft such that each of the radial elements of one annulus are coplanar with one radial element of the other annulus. The peripheral elements 23 of this species of mixer communicate between the annuli 20 and 21 in quadrantal array at the ends of each pair of coplanar radial elements, as in the first species of mixer, but because of the difference in diameter of the two annuli the peripheral elements will be angulated to the axis of the powering shaft. This second species of mixer is formed from rod-like elements of the same nature as the first species and the elements are structurally interconnected in the same fashion.

Though the second species of mixer with annuli of different sizes shows the smaller annuli being lower or outermost, this is not intended to be limiting and the larger annuli may be outermost and the smaller annuli innermost. Both variants are within the ambit and scope of my invention.

This second species of mixer is operative in mixing the same materials as the first species and operates in substantially the same fashion, but may not be so efficient as is the first species. It appears that as the angulation of the sides of the mixing device of the second species move further, with greater angulation, from a cylindrical configuration, the overall mixing efficiency in a composite of materials tends to be less efficient, roughly in proportion to the variation of the angulation from that of a cylinder through an orientation parallel to the powering shaft.

Powering source 11 is not an essential part of my mixer, but necessary for its practical use to provide rotary motion for the powering shaft. The powering source may be any of the various known devices for creating rotary motion in a shaft, but most commonly, by reason of availability and convenience, it will be an electric drill-type tool 17 as illustrated. An electric drill provides rotary speeds at which it commonly is desired that the mixer be rotated and many such tools allow variation of the rotational speed within a fairly wide range which encompasses most, if not all, of the range desired for rotary mixing of materials of various viscosities. The specification of an electrically powered drill as a powering source is not, however, intended to be limiting and any tool that provides powered rotation in general may be used as a powering source.

Having described the structure of my mixing device, its operation may be understood.

For use, a mixer formed in accordance with the foregoing specification is operatively attached to a powering source 11, placed in a contained volume of material to be mixed and rotated therein in either direction at an appropriate speed. Commonly the material that is to be mixed will be supported in a container that is shaped somewhat similarly to the mixer and is not too much larger than the mixer, with a diameter preferably of not more than two to three times the diameter of the mixer. The depth of the material in the container preferably is at least as deep as the vertical dimension of the mixer and preferably not more than two to four times the vertical dimension of the mixer. The mixer preferably is oriented in such a container in a medial position with powering shaft 14 in substantially vertical orientation. These preferred mixing conditions set forth are not intended to be limiting, however, but merely provide ideal mixing conditions. The mixer may be used in fluidic materials of almost any volume and containment configuration so long as the mixer may be at least partially immersed therein. In large volumes of material that extend over substantial areas, the mixer may be moved to different areas within the volume of material to aid uniform mixing throughout the volume, especially in more viscous type materials.

The speed of rotation of the mixer is preferably adjusted to accommodate to the nature of the material for efficient mixing, with rotary speeds being greatest in the most fluidic materials and decreasing as the viscosity and particulate content of the material increases. Materials having a viscosity such as water may be mixed with rotary speeds of one thousand rpm or more, whereas semi-fluidic materials such as thicker paints may require a speed of three or four hundred rpm and quasi-fluidic materials such as mortar, concrete or similar slurries may require rotational speeds of less than one hundred rpm. Efficient rotary speeds may be quite readily determined by a user from empirical parameters or experimentation to accomplish most efficient mixing, but preferably with quite fluidic and more fluidic viscous materials should be such as to create a vortex in the material.

It is to be noted that my mixer may be efficiently used for mixing fluidic, semi-fluidic and quasi-fluidic materials with equal facility when the speed of rotation is appropriately related to the nature of the material to produce efficient mixing action. By reason of the larger cross-sectional size of the elements from which my mixing apparatus is formed, there is a dual mixing action caused firstly, by displacement of material in a container about the mixing device as the various elements of the mixing device rotate in that material. Secondly, my mixing apparatus in moving through material being mixed causes friction as the surfaces of the mixer elements move relatively to the material adjacent to the mixer to cause more motion or turbulence in the material. Both of these actions tend to cause local areas of material to move relative to adjacent areas of material to accomplish the mixing function. This mixing function is synergistically magnified and accelerated by the instant mixing device when compared with mixing apparatus of a similar type as known in the prior art. The size of my mixing device may vary widely, depending upon the volume and nature of material that is to be mixed, but the efficiency of its mixing action generally becomes less if the overall diameter of the mixer is increased to more than about twelve inches. In general as my mixing device increases in size, the rotary speed at which efficient mixing will occur varies inversely and will tend to maintain a somewhat constant circular velocity of the mixing elements. The mixing action itself tends to change as size of the mixing apparatus increases, with a greater part of mixing being accomplished by surface friction in the material being mixed rather than by displacement.

The foregoing specification of my invention is necessarily of a detailed nature so that a specific embodiment of it might be set forth as required, but it is to be understood that various modifications of detail, rearrangement and multiplication of parts may be resorted to without departing from its spirit, essence or scope.

Having thusly described my invention, what I desire to protect by Letters Patent, and

What I claim is:

1. A rotary mixer for fluidic materials, comprising in combination:

an elongate powering shaft having first and second end portions and carrying at the second end portion a mixing device having a first annulus with quadrantally arrayed first radial elements interconnecting the second end portion of the powering shaft and the first annulus, the first annulus defining a first circular periphery, a second annulus having quadrantally arrayed second radial elements interconnecting the powering shaft, spacedly inwardly of the second end portion, and the second annulus, with each of the second radial elements coplanar with one of the first radial elements carried by the first annulus, the second annulus defining a second circular periphery, and elongate linear peripheral elements extending in structural connection between the first and second annuli immediately adjacent the radially outer end of each pair of coplanar first and second radial elements carried by the first and second annuli, the elongate linear peripheral elements being located within the first and second circular peripheries.

2. The rotary mixer of claim 1 further characterized by:

the first and second radial elements, the peripheral elements and the powering shaft formed from elongate rod having a circular cross-sectional configuration.

3. The rotary mixer of claim 1 wherein the volume of the first and second radial elements, the peripheral elements, the first and second annuli and the powering shaft between the two annuli comprises ten to twenty percent of the volume defined by a figure containing the mixer in immediately adjacent relationship.

4. The rotary mixer of claim 3 wherein the volume of the first and second radial elements, the peripheral elements, the first and second annuli and the powering shaft between the two annuli is substantially thirteen percent of the volume defined by the figure.

5. The rotary mixer of claim 1 wherein the first and second annuli are of the same diametrical size.

6. The rotary mixer of claim 1 wherein the first and second annuli are of different diametrical sizes to form a mixing device that defines a truncated cone as a containing figure.

7. A rotary mixer for fluidic, semi-fluidic and quasi-fluidic materials, comprising in combination:

an elongate central powering shaft having first and second end portions with means for interconnecting a powering source at the first end portion, and a mixing device carried at the second end portion, said mixing device having a first circular annulus with quadrantally arrayed first radial elements interconnecting the first annulus to the second end portion of the powering shaft, the first annulus defining a first circular periphery, a second circular annulus of the same size as the first annulus having quadrantally arrayed second radial elements interconnecting the second annulus to the powering shaft spacedly inwardly from the second end, with each second radial element of the second annulus being coplanar with one of the first radial elements of the first annulus, the second annulus defining a second circular periphery, and elongate linear peripheral elements extending in interconnected quadrantal array between the first and second annuli, with each peripheral element immediately radially outwardly adjacent the radially outer end portions of each pair of the coplanar first and second radial elements, the elongate linear peripheral elements being located within the first and second circular peripheries.

* * * * *